United States Patent [19]

Yeh

[11] 4,145,899

[45] Mar. 27, 1979

[54] LAUNDRY BASIN STRUCTURE HAVING INDEPENDENTLY PIVOTING WASHING BARS

[76] Inventor: Muh G. Yeh, 34 Lane 221, Ta Tung N. Rd., San Chung City, Taiwan

[21] Appl. No.: 849,618

[22] Filed: Nov. 8, 1977

[51] Int. Cl.[2] ..... D06F 13/00

[52] U.S. Cl. ..... 68/134

[58] Field of Search ..... 68/131–134, 68/38, 53, 54, 92, 173, 174, 184, 212, 232, 233

[56] References Cited

U.S. PATENT DOCUMENTS 1,665,262 4/1928 Hirschy ..... 68/34

FOREIGN PATENT DOCUMENTS 905731 3/1954 Fed. Rep. of Germany ..... 68/134

*Primary Examiner*—Philip R. Coe

*Attorney, Agent, or Firm*—Cushman, Darby & Cushman

[57] ABSTRACT

A new structural design for a washing basin within a laundry machine wherein independently pivoting washing bars are attached at suitable spacings to the basin. Said washing bars may be pivoted to any angle by means of the water flow. The toughness and flexibility of the washing bars disrupt the water flow, frictionally engage the items being washed and knock the items so as to enhance the cleaning process.

The dependently pivoting washing bars have spherical bases which are pivotably positioned on the outer wall of the laundry basin by packing rings and sockets. The washing bars extend through soft water proofing washers protecting caps on the inner surface of the basin wall. When a bar is struck by the rotating water, the spherical base may freely rotate within the socket permitting the bar to rotate so as to disrupt the water flow and to frictionally engage the items being washed. The flexing of the washing bars caused by the water flow will make more turbulent the water flow in order to facilitate the washing effect of the laundry machine.

3 Claims, 4 Drawing Figures

LAUNDRY BASIN STRUCTURE HAVING INDEPENDENTLY PIVOTING WASHING BARS

BACKGROUND OF THE INVENTION

The present invention relates generally to washing basins for laundry machines. Generally, cleaning, in laundry machines, is accomplished by shrinking and expanding the structure of the items being cleaned so that the dirty material and scale accumulated on the items may be easily removed as the items are manipulated. The conventional laundry machine has a basin with smooth and flat surfaces. As a result, the water flow inside the conventional laundry basin does not maximize the cleaning process.

SUMMARY OF THE INVENTION

In the present invention, independently pivoting washing bars are attached to the laundry basin cause a significant disruption of the water flow and so as to knock, twist and thoroughly clean the items being washed.

Each bar has a spherical base which may also rotate within a base socket. Each of the sockets is biased against a packing ring positioned proximate the wash basin by means of four springs mounted on screws. The spherical base is positioned between the packing ring and socket, and is urged toward the packing ring, and therefore the basin wall, by the springs. Whenever a force is extending on a washing bar by the water flow within laundry basin, the bar will be pivoted and bent as the spherical base is rotating within the socket so as to disrupt the water flow and knock, twist and clean the item in the basin thoroughly.

DESCRIPTION OF THE PREFERRED EMBODIMENT

Figure 1:
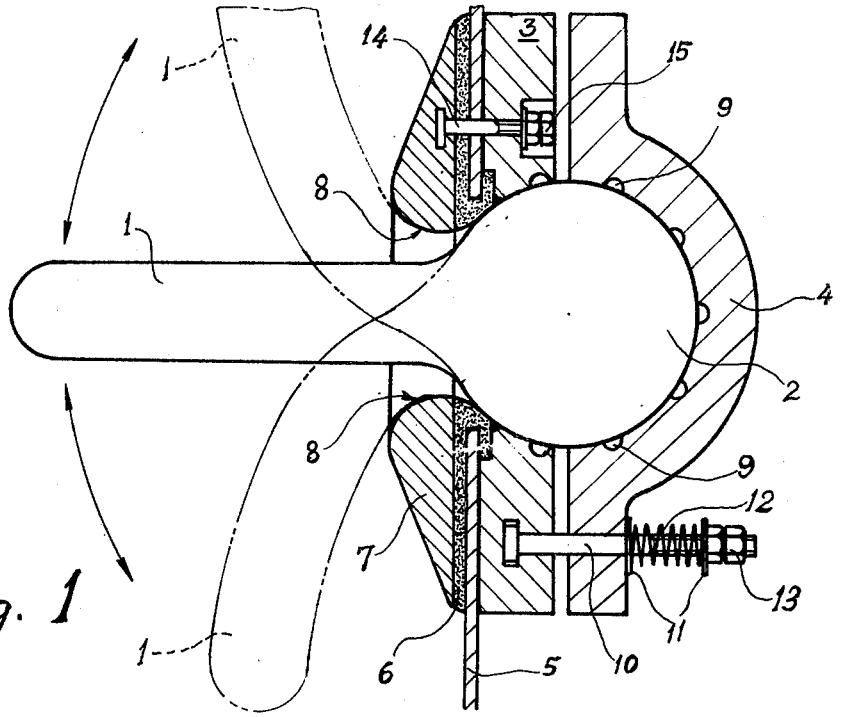
FIG. 1 is a sectional drawing of the laundry basin wall having the washing bars in accordance with the present invention.

As shown in the drawings, washing bar (1) and the spherical base (2) of the bar are made integrally of high grade rubber or plastics having the characteristics of strength toughness and flexibility. Spherical base (2) is connected to the basin wall by packing ring (3) and socket (4). Washing bar (1) extends through basin wall (5), soft washer (6) and protecting cap (7).

In order to prevent the water leakage, curvature of opening (8) of protecting cap (7) and the soft washer may correspond to the curvature between washing bar (1) and the spherical base (2). The design of opening (8) enables closer contact between washing bar (1) and to prevent water leakage and prolong the service life of the laundry machine.

Whenever water applies a force to washing bar (1), spherical base (2) may rotate within packing ring (3) and socket (4) so that bar (1) may rotate 360 degrees, i.e., the end of bar (1) not attached to base (2) may move so as to define a portion of a sphere. Packing ring (3) and socket (4) are provided with oil grooves (9) to enable lubrication use.

Figure 2:
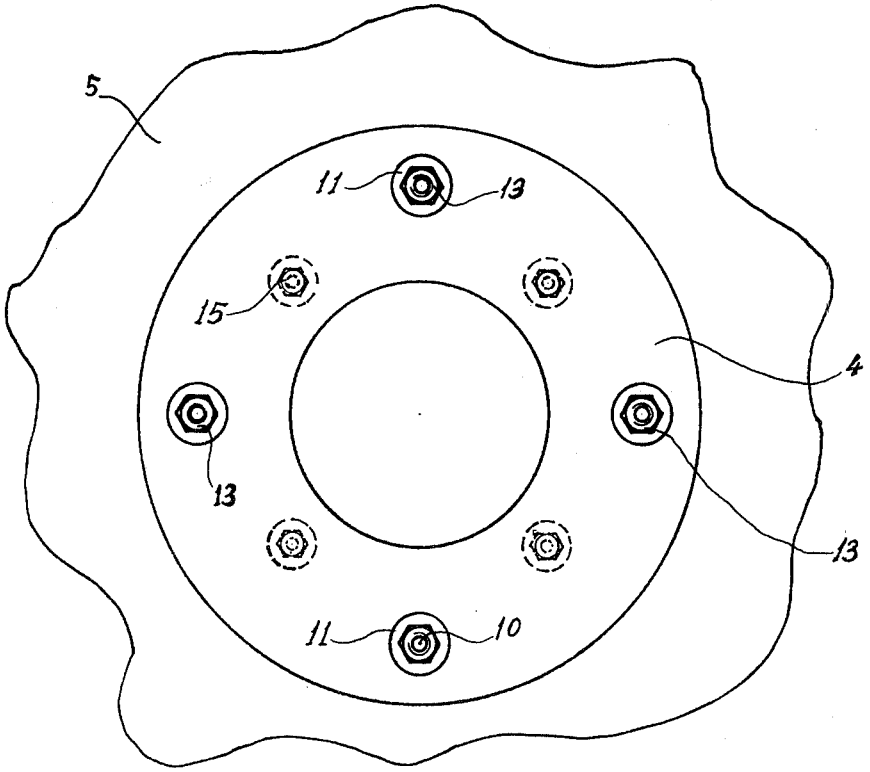
FIG. 2 is the drawing showing the allocation of fixation screws of the packing ring and socket outside the basin wall.
Figure 3:
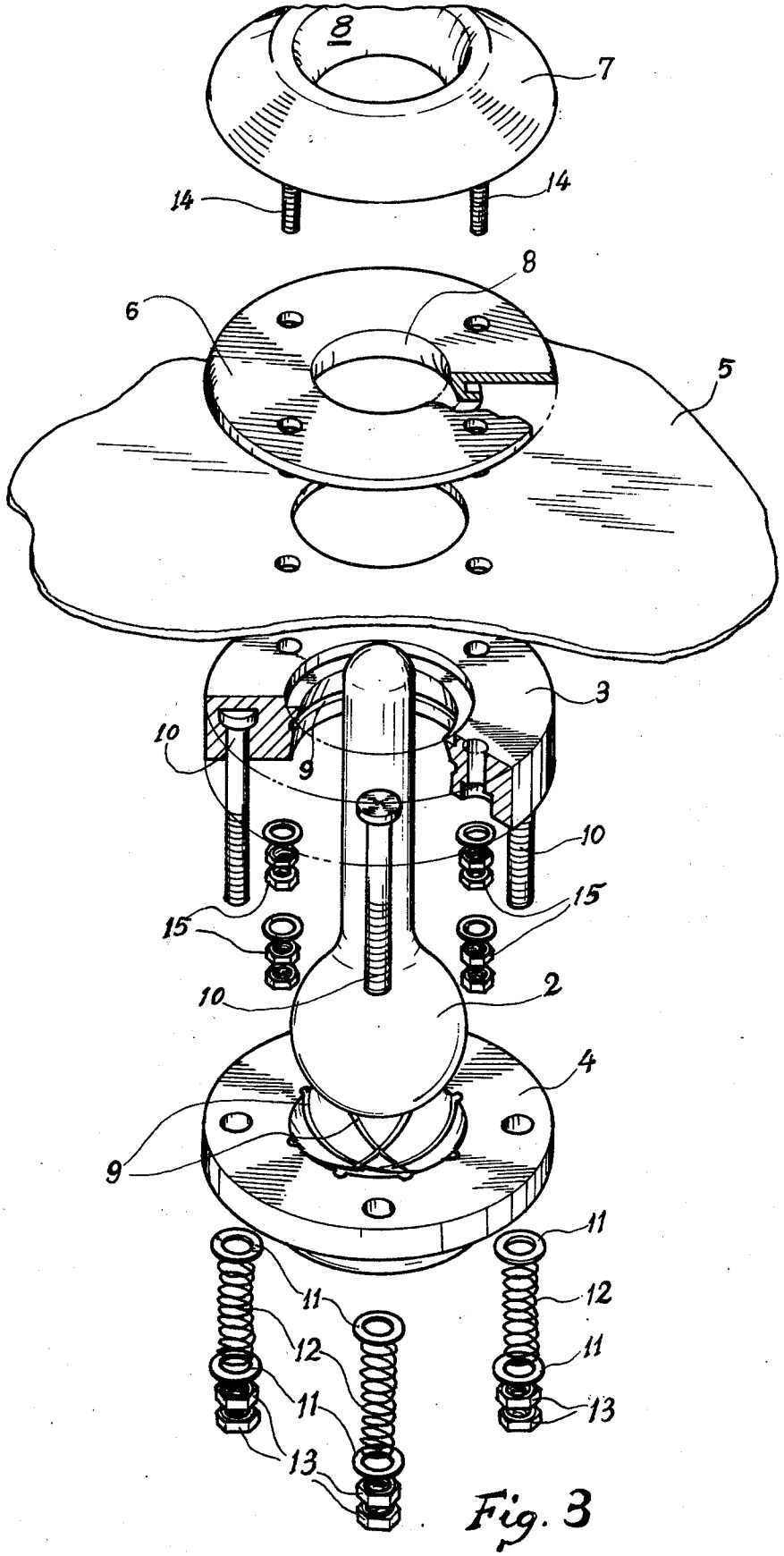
FIG. 3 is the perspective drawing of the parts of the preferred embodiment is accordance with the present invention.

As shown in FIGS. 2 & 3, socket (4) is attached to packing ring (3) by four screws (10) extending from packing ring (3) and passing through socket (4). The end of each of screws (10) is held in position by washer (11), spring (12) and 2 nuts (13). Packing ring (3) is attached to wall (5) by screws (14) of protecting cap (7) which pass through soft washer (6) and basin wall (5) and the packing ring itself. The end of each of screws (14) is held in position by nut (15). The effect of spring (12) is to keep a suitable pressure on spherical base (2) and adhesive between spherical base (2) and packing ring (3). It cooperates with soft washer (6) to enhance the absorption and buffering of vibration and the prevention of water or oil leakage.

As shown in FIG. 1, when washing bar (1) is struck by the water flow and deflected to the utmost position as shown by the dotted line, the toughness & flexibility of the bar will disrupt the water flow and cause turbulence which will aid in complete cleaning.

The maximum deflection angle of washing bar (1) may correspond to the slope of protecting cap (7) which angle is selected so as not to tangle the small clothings and so as to enhance the frictional and turbulence effects of the bar.

Figure 4:
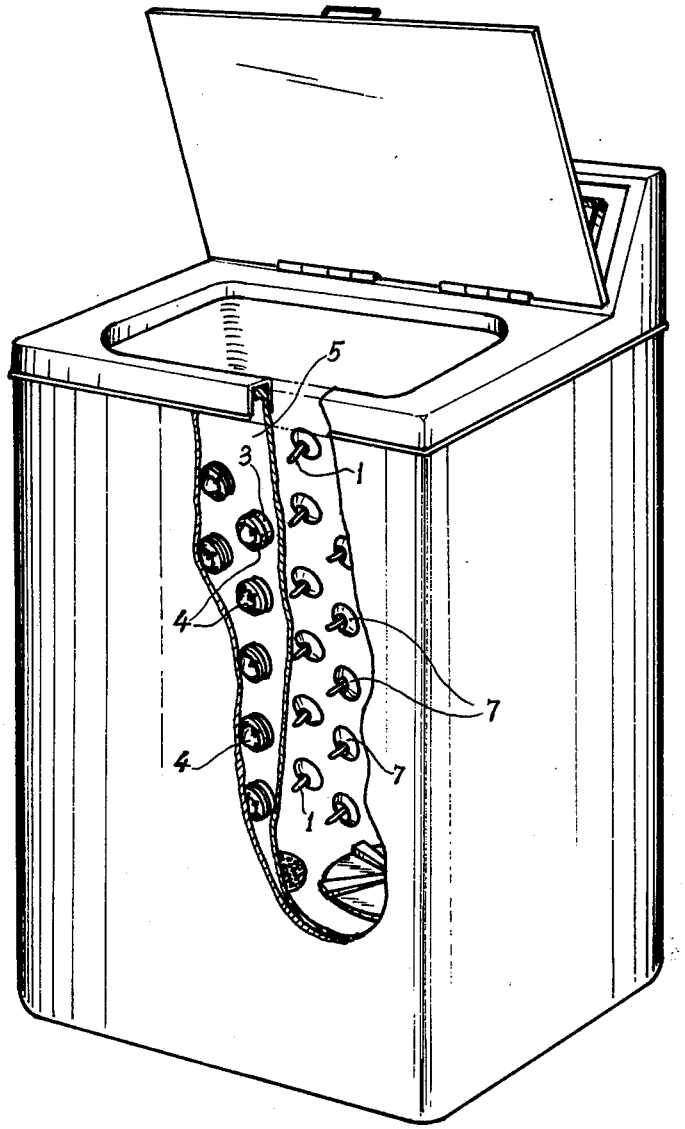
FIG. 4 is the partial sectional drawing of the laundry machine in accordance with the present invention.

As rotating the pan provided on the bottom of the laundry machine (FIG. 4) is rotated, the water flow will cause washing bars (1) to deflect and vibrate thereby aiding the cleaning process.

The effects of the present invention includes:

(a) Disrupting the flow of rotating water;

(b) Rubbing and twisting the clothing; and (c) Knocking the clothing and enhancing the diffusion of water through items being washed by means of the vibration of the washing bar.

I claim:

1. A washing basin for a laundry machine comprising:

walls defining an interior region wherein washing water is contained by said walls;

a plurality of flexible washing bars;

a plurality of spherical bar bases, each of said bases being rigidly attached to one of said bars, respectively; and means for pivotably mounting said bases on said basin walls, said bars extend inwardly into said interior region, said mounting means enabling said bases to pivot in such a way that the ends of said bars not attached said bases may move so as to define a portion of a sphere, so that when a force is exerted on said bars by water flowing in said basin, said bars pivot, bend and vibrate so as to aid the cleaning processes.

2. A washing basin for a laundry machine comprising:

walls defining an interior region wherein washing water is contained by said walls and an exterior region;

a plurality of flexible washing bars;

a plurality of spherical bar bases, each of said bases being integrally formed with one of said bars, respectively;

first means for pivotably mounting said bases on said basin walls in said exterior region, each of said first means comprising a packing ring disposed proximate said basin and a socket for pressing the one of said bases associated with said packing ring and socket against said packing ring;

second means for limiting the angular play of said bars and for maintaining said basin watertight, each of said second means comprising a washer disposed proximate said basin walls in said interior region and a protecting cap disposed proximate said washer, said basin and each said washer and protecting cap comprising third means defining a hole therethrough, the respective one of said bars extending through said hole into the said interior region, the curvature of said third means corresponding to the curvature of said bars and bases so as to increase the contact between said bars and bases and said third means.

3. Apparatus as in claim 2 wherein each said socket comprises a contact surface for contacting the respective one of said bases, means for defining grooves in said contact surface, and means for supplying lubricant to said grooves; and said apparatus further comprising screws for attaching each said socket to the respective said packing ring and spring means slidably attached to said screws for biasing each said socket against the respective said packing ring, thereby positioning the respective one of said bases.

* * * * *